US010647388B2

(12) United States Patent
Onodera

(10) Patent No.: US 10,647,388 B2
(45) Date of Patent: May 12, 2020

(54) JET BOAT

(71) Applicant: YAMAHA HATSUDOKI KABUSHIKI KAISHA, Iwata-shi, Shizuoka (JP)

(72) Inventor: Ren Onodera, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/249,942

(22) Filed: Jan. 17, 2019

(65) Prior Publication Data

US 2019/0144075 A1 May 16, 2019

Related U.S. Application Data

(63) Continuation of application No. 15/704,119, filed on Sep. 14, 2017, now abandoned, which is a continuation of application No. 14/872,250, filed on Oct. 1, 2015, now Pat. No. 9,796,452.

(30) Foreign Application Priority Data

Jan. 6, 2015 (JP) ..... 2015-000763

(51) Int. Cl.
*B63B 3/48* (2006.01)
*B63B 29/02* (2006.01)

(52) U.S. Cl.
CPC ..... *B63B 3/48* (2013.01); *B63B 29/02* (2013.01)

(58) Field of Classification Search
CPC .. B63B 3/00; B63B 3/48; B63B 29/00; B63B 29/02; B63B 29/04; B63B 29/06; B63B 17/00; B63B 43/00; B63B 43/12; B63B 19/00; B63B 19/14
USPC ..... 114/361, 363; 440/38, 111, 112
See application file for complete search history.

(56) References Cited

U.S. PATENT DOCUMENTS 4,982,682 A * 1/1991 Hattori ..... B63B 43/12 114/363
7,000,557 B1 * 2/2006 Forbes ..... B63B 29/02 114/201 R
8,113,136 B2 * 2/2012 Mayrand ..... B63B 29/02 114/363
8,616,143 B2 * 12/2013 Hancock, Jr. ..... B63B 19/12 114/201 R
9,796,452 B2 * 10/2017 Onodera ..... B63B 29/02

OTHER PUBLICATIONS

Onodera, "Jet Boat", U.S. Appl. No. 15/704,119, filed Sep. 14, 2017.

* cited by examiner

*Primary Examiner* — Lars A Olson
(74) *Attorney, Agent, or Firm* — Keating and Bennett, LLP

(57) ABSTRACT

A jet boat includes a cockpit arranged in a central portion of the jet boat on a boat body centerline, a bulwark provided along a circumference of a deck, and a platform fixed to a stern. In the bulwark, the upper surface of a rear bulwark between the platform and the cockpit is located above the upper surface of a foot space and below the seating surface of a seat.

20 Claims, 5 Drawing Sheets

JET BOAT

CROSS-REFERENCE TO RELATED APPLICATION

This application claims priority to Patent Application No. 2015-000763 filed in Japan on Jan. 6, 2015, the entire contents of which are hereby incorporated by reference.

BACKGROUND OF THE INVENTION

1. Field of the Invention

The present invention relates to a jet boat.

2. Description of the Related Art

A jet boat that obtains propulsion power by ejecting water by a jet propulsion unit mounted on a boat body is known in general. Such a jet propulsion unit is disclosed in U.S. Published Patent Application No. 2013/0104793, for example.

U.S. Published Patent Application No. 2013/0104793 discloses a tender (jet boat) including a hull, a deck, a cockpit provided on the deck, a bulwark arranged along the circumference of the deck so as to extend upward, and a stern deck provided on a stern and that is driven by an impeller-driven pump jet. In the tender according to U.S. Published Patent Application No. 2013/0104793, the bulwark is arranged between the deck and the stern deck, and a seat is fixed to the upper surface of the deck. In U.S. Published Patent Application No. 2013/0104793, the upper surface of the bulwark is arranged above the upper surface of the deck and the seating surface of the seat.

In the tender according to U.S. Published Patent Application No. 2013/0104793, the upper surface of the bulwark between the deck and the stern deck is arranged above the seating surface of the seat, and hence a distance from the upper surface of the deck to the upper surface of the bulwark in a height direction is disadvantageously larger than a distance from the upper surface of the deck to the seating surface of the seat in the height direction. Thus, due to the distance from the upper surface of the deck to the upper surface of the bulwark in the height direction, which is larger than the distance from the upper surface of the deck to the seating surface of the seat in the height direction, a user is required to climb over the bulwark by raising his/her foot in the height direction when moving from the deck to the stern deck, and hence it is difficult for the user to easily move from the deck to the stern deck.

SUMMARY OF THE INVENTION

Preferred embodiments of the present invention provide a jet boat that allows a user to easily move from a deck to a platform at a stern of the jet boat.

A jet boat according to a preferred embodiment of the present invention includes a boat body including a hull and a deck; an engine housed in the hull below the deck; a jet propulsion unit driven by the engine; a cockpit arranged in a central portion of the boat body in a longitudinal direction and on a boat body centerline that extends in the longitudinal direction of the boat body on the deck; the cockpit including a seat provided on the deck, a handle, and a foot space between the seat and the handle; a bulwark that extends upward along the circumference of the deck to prevent entry of waves onto the deck, and a platform fixed to a stern of the jet boat. The upper surface of a rear bulwark arranged between the platform and the cockpit is located above the upper surface of the foot space and below the seating surface of the seat.

In the jet boat according to the above preferred embodiment, the upper surface of the rear bulwark arranged between the platform and the cockpit is located above the upper surface of the foot space and below the seating surface of the seat. Thus, the upper surface of the rear bulwark is arranged below the seating surface of the seat, and hence a user is able to step over the rear bulwark simply by slightly raising his/her foot in a height direction when moving from the deck to the platform. Consequently, the user easily moves from the deck to the platform.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a jet boat 100 according to preferred embodiments of the present invention is now described with reference to FIGS. 1 to 6. The jet boat 100 is preferably suitable for fishing, for example. In the figures, arrow FWD represents the forward movement direction (bow side) of the jet boat 100, and arrow BWD represents the reverse movement direction (stern side) of the jet boat 100. A traveling direction including the forward movement direction and the reverse movement direction is the same as the longitudinal direction of the jet boat 100. In the figures, arrow R represents the starboard direction (one side of a width direction) of the jet boat 100, and arrow L represents the portside direction (the other side of the width direction) of the jet boat 100.

Figure 1:
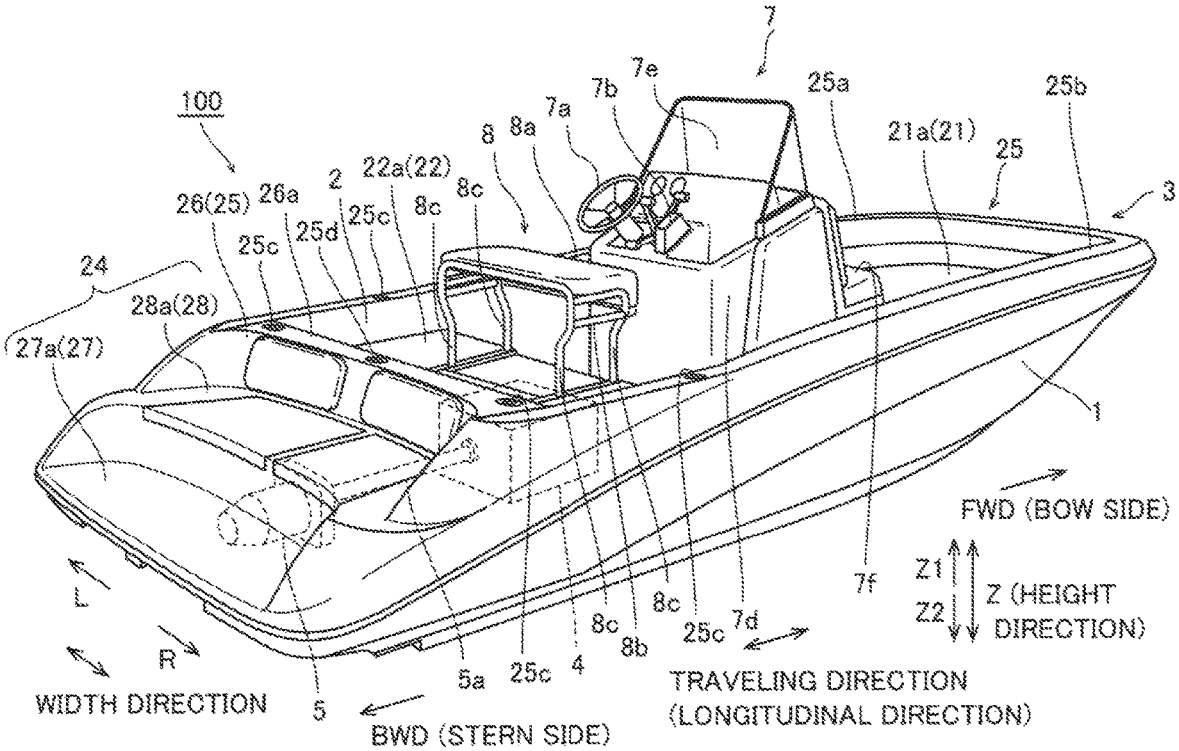
FIG. 1 is a perspective view showing a jet boat according to a preferred embodiment of the present invention.
Figure 2:
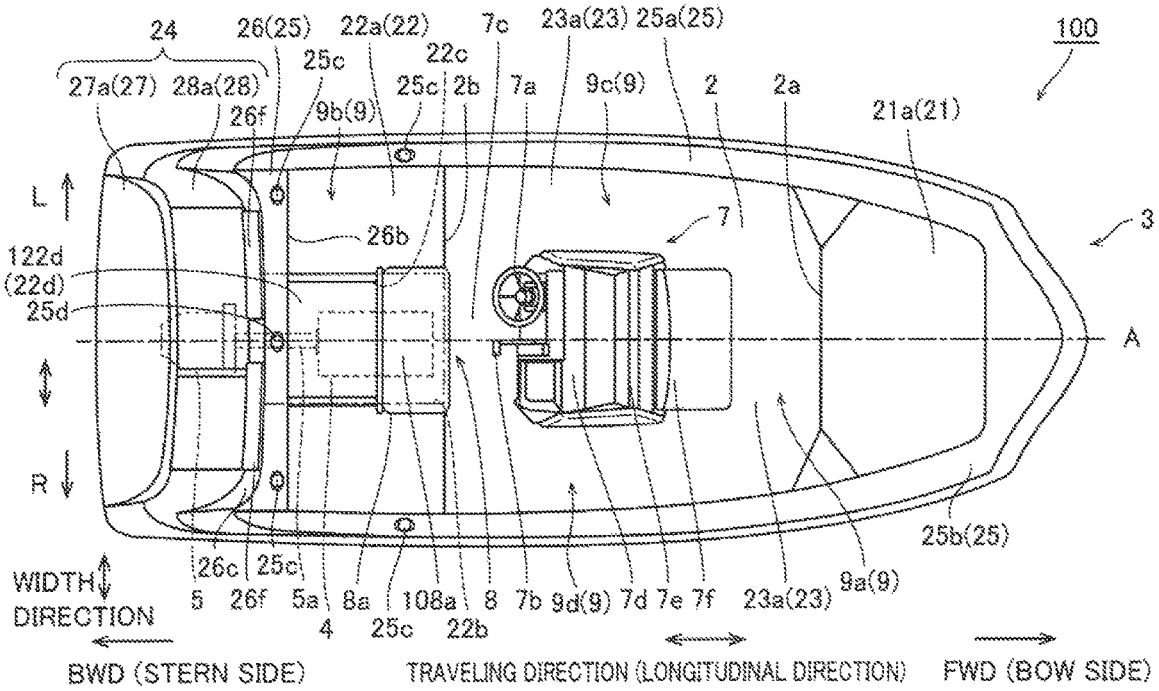
FIG. 2 is a plan view showing the jet boat according to a preferred embodiment of the present invention.

The jet boat 100 includes a boat body 3 including a hull 1 and a deck 2, an engine 4 housed in the hull 1, a jet propulsion unit 5 connected to the engine 4, and a battery 6 (see FIG. 4) that provides electricity to the above components, as shown in FIGS. 1 and 2.

Figure 3:
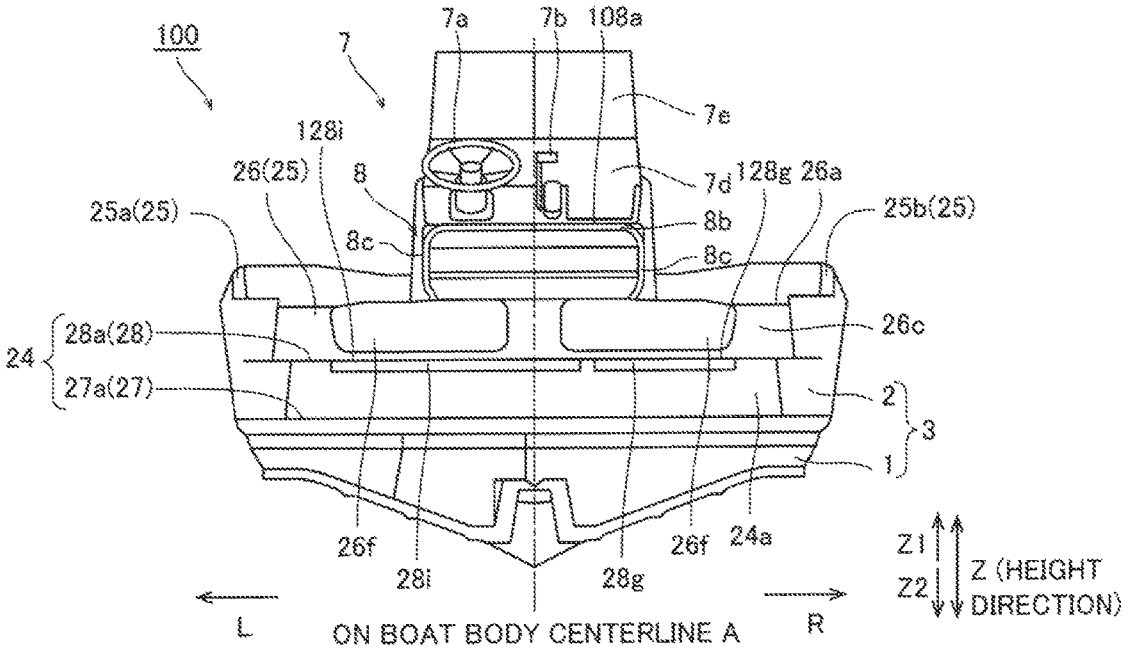
FIG. 3 is a rear elevational view showing the jet boat according to a preferred embodiment of the present invention.

The deck 2 is attached to the hull 1 along the entire circumference of a circumferential edge so as to cover the hull 1 from above. The deck 2 includes a front deck 21 provided on the bow side, a rear deck 22 provided on the stern side, a central deck 23 provided between the front deck 21 and the rear deck 22 in the longitudinal direction of the boat body 3, and a platform 24 provided on the stern side relative to the rear deck 22. As shown in FIG. 3, the platform 24 is integral with the deck 2 and is fixed to a stern of the jet boat 100. The platform 24 is described below. The rear deck 22 is an example of "rear passage" according to a preferred embodiment of the present invention.

Figure 4:
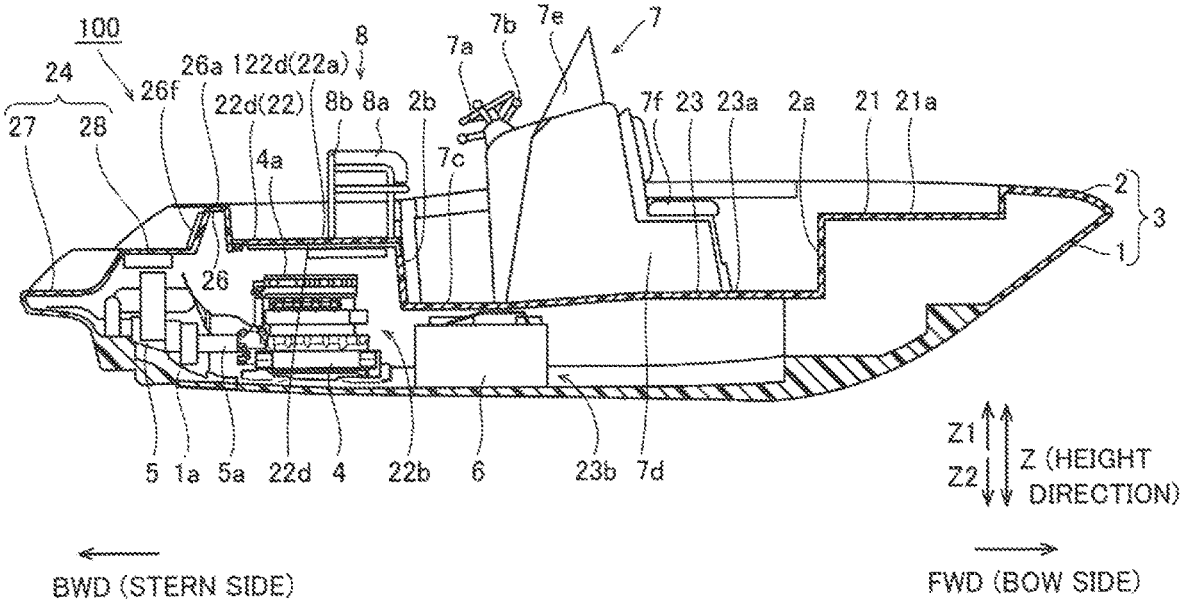
FIG. 4 is a sectional view of the jet boat according to a preferred embodiment of the present invention, taken along the longitudinal direction of a boat body.
Figure 5:
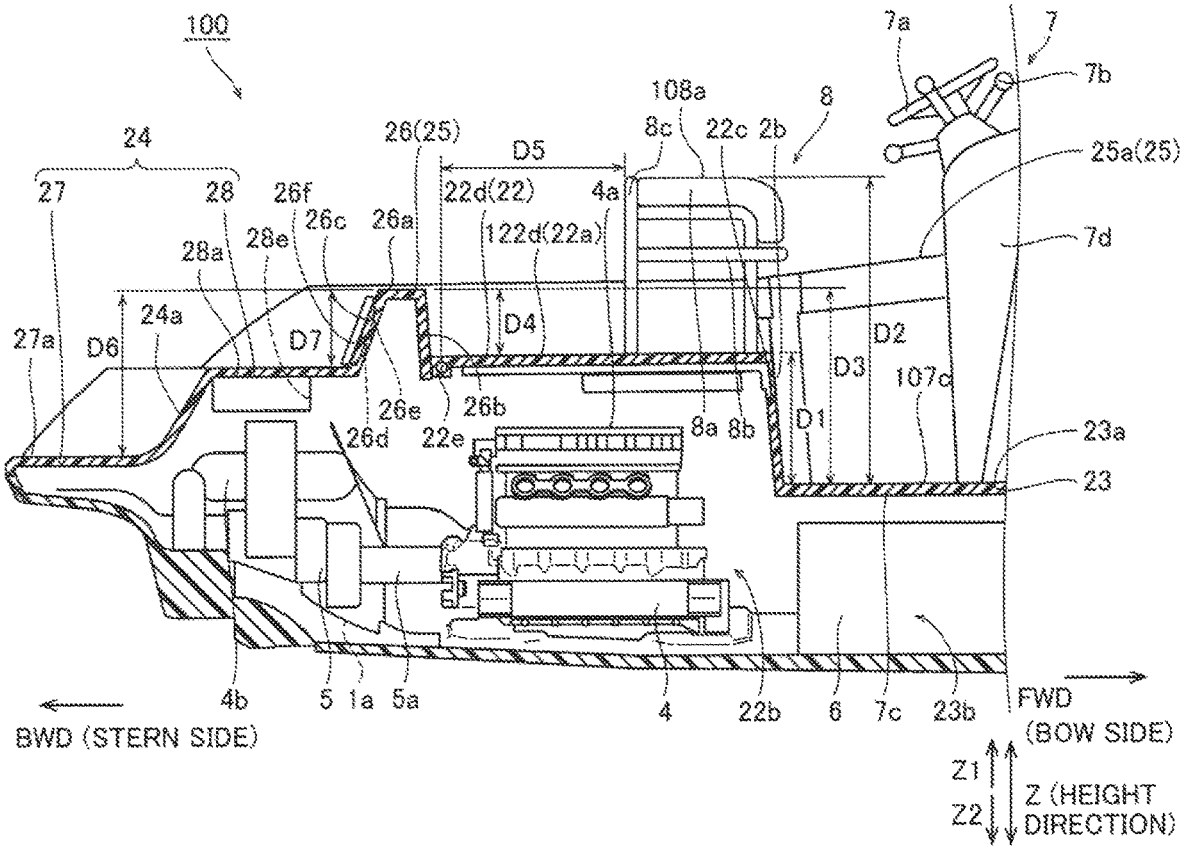
FIG. 5 is an enlarged sectional view showing the jet boat according to a preferred embodiment of the present invention.

The upper surface 21*a* of the front deck 21 and the upper surface 22*a* of the rear deck 22 are located above (in the direction Z1) the upper surface 23*a* of the central deck 23, as shown in FIG. 4. The upper surface 21*a* of the front deck 21 and the upper surface 23*a* of the central deck 23 are connected to each other through a step surface 2*a* that extends in a height direction (direction Z). The upper surface 22*a* of the rear deck 22 and the upper surface 23*a* of the central deck 23 are connected to each other through a step surface 2*b* that extends in the height direction. The deck 2 is stair-shaped, and hence the rear deck 22 is where a user is seated on the deck 2. As shown in FIG. 5, a distance D1 (the height of the step surface 2*b*) from the upper surface 23*a* of the central deck 23 to the upper surface 22*a* of the rear deck 22 in the height direction is preferably about 420 mm, for example.

In a region that is below (in the direction Z2) the rear deck 22 and corresponds to the rear deck 22, an engine housing 22*b* defined by the rear deck 22 and the hull 1 is provided. In a region that is below the central deck 23 and corresponds to the central deck 23, a battery housing 23*b* defined by the central deck 23 and the hull 1 is provided. The engine 4 and the battery 6 are housed in the engine housing 22*b* and the battery housing 23*b*.

Figure 6:
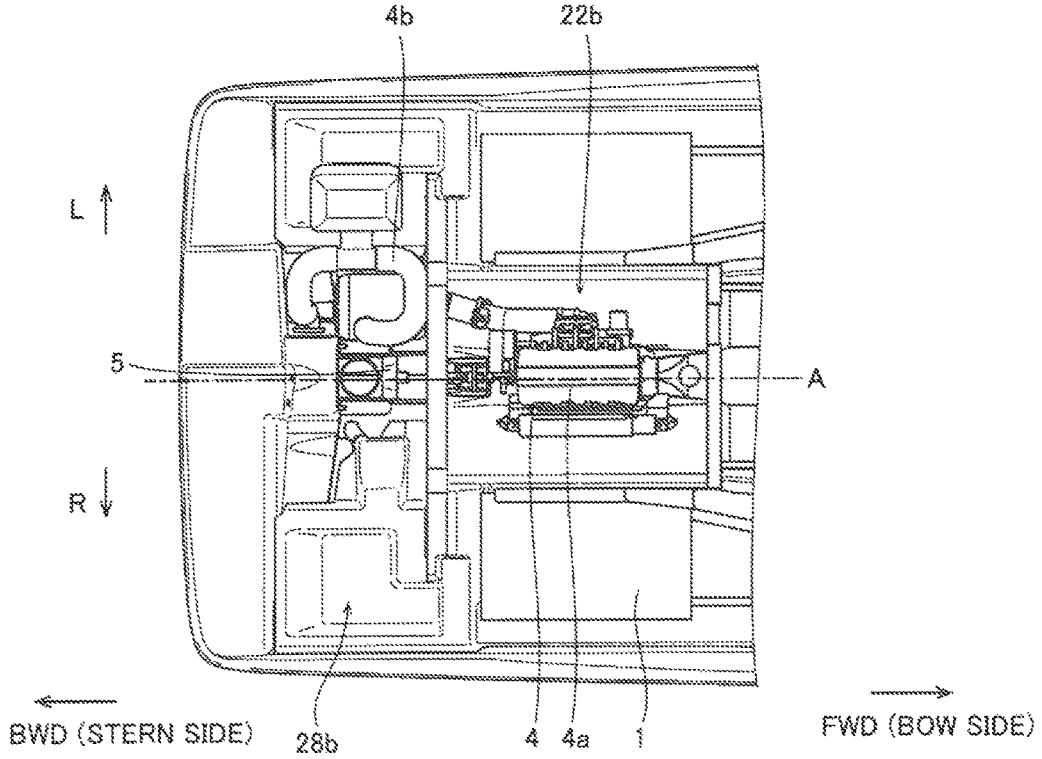
FIG. 6 is a plan view showing a state where a deck is removed from the jet boat according to a preferred embodiment of the present invention.

The engine housing 22*b*, excluding an upper portion defined by the rear deck 22, is defined by the inner surface of the hull 1, and hence the engine 4 housed in the engine housing 22*b* is housed in the hull 1. The engine housing 22*b* is located on a boat body centerline A, as shown in FIG. 6, and hence the engine 4 is also located on the boat body centerline A.

The side surface of the engine 4 in the portside direction is connected to an exhaust portion 4*b* in which the exhaust air of the engine 4 circulates. The exhaust portion 4*b* is arranged in a space in the portside direction relative to the engine 4 and thereafter is connected to an ejection hole 1*a* (see FIG. 4) provided in a bottom portion of the hull 1. Consequently, the exhaust air that circulates in the exhaust portion 4*b* is discharged outside together with the flowing water of the jet propulsion unit 5 through the ejection hole 1*a*.

The deck 2 is provided with a bulwark 25 that surrounds the front deck 21, the rear deck 22, and the central deck 23 from the outside, as shown in FIGS. 1 and 2. The bulwark 25 is arranged along the circumference of the deck 2 so as to extend upward (in the direction Z1) and significantly reduces or prevents entry of waves onto the deck 2 (the front deck 21, the rear deck 22, and the central deck 23).

The bulwark 25 includes a portside bulwark 25*a* provided on the portside of the deck 2, a starboard bulwark 25*b* provided on the starboard of the deck 2, and a rear bulwark 26 arranged between the rear deck 22 and the platform 24 in the longitudinal direction of the boat body 3. The portside bulwark 25*a* and the starboard bulwark 25*b* preferably have shapes that are symmetrical or substantially symmetrical to each other with respect to the boat body centerline A. Both the portside bulwark 25*a* and the starboard bulwark 25*b* preferably have gradual slopes such that the upper surfaces thereof on the bow side are located above the upper surfaces thereof on the stern side. The rear bulwark 26 is described below.

The bulwark 25 is preferably provided with four rod holders 25*c*, for example, to mount shown fishing rods (not shown) and a navigation light mounting hole 25*d* to mount a navigation light (not shown). The respective rod holders 25*c* are provided on a portion of the portside bulwark 25*a* on the stern side, a portion of the starboard bulwark 25*b* on the stern side, a portion of the rear bulwark 26 in the starboard direction, and a portion of the rear bulwark 26 in the portside direction. The navigation light mounting hole 25*d* is provided in a central or substantially central portion of the rear bulwark 26 in the width direction.

The jet propulsion unit 5 is connected to a portion of the engine 4 on the stern side through a drive shaft 5*a*. In the jet propulsion unit 5, water flow generated by rotating an impeller (not shown) with the engine 4 is ejected toward the stern side through the ejection hole 1*a* (see FIG. 4) in a boat bottom, and hence the jet boat 100 moves forward.

As shown in FIG. 2, a cockpit 7 is arranged on the central deck 23. The cockpit 7 is preferably provided on the boat body centerline A that extends in the longitudinal direction in a central portion of the boat body 3 in the width direction.

The cockpit 7 includes a seat 8, a handle 7*a*, a lever 7*b*, and a foot space 7*c* provided between the seat 8 and both the handle 7*a* and the lever 7*b*. The handle 7*a* and the lever 7*b* are mounted on an upper portion of a console 7*d* provided in a portion of the foot space 7*c* toward the bow side in a central portion of the boat body 3. A transparent windbreak plate 7*e* that blocks wind from the bow side is arranged on a portion of the console 7*d* on the bow side. A front seat 7*f* on which a passenger is seated is provided on the side surface of the console 7*d* on the bow side.

The seat 8 is fixed to the rear deck 22. The seat 8 includes a seating surface 8*a* on which the user (not shown) is seated and a supporting portion 8*b* that supports the seating surface 8*a* from below, as shown in FIG. 1. The seating surface 8*a* is provided on the entire upper surface of the seat 8 and an upper portion of the side surface of the seat 8 on the bow side. The supporting portion 8*b* includes four legs 8*c*, for example. In the four legs 8*c*, upper portions thereof are slightly broader in the width direction of the boat body 3 than lower portions thereof. In a region surrounded by the four legs 8*c*, a cool box (not shown) preferably is housed.

The handle 7*a* pivots a nozzle (not shown) of the jet propulsion unit 5 right and left based on the user's operation so as to turn the jet boat 100 right and left. The lever 7*b* pivots a reverse gate (not shown) of the jet propulsion unit 5 up and down based on the user's operation so as to switch between the forward movement and the reverse movement of the jet boat 100.

The foot space 7*c* occupies a portion of the central deck 23, as shown in FIG. 2, and the user that maneuvers the jet boat 100 in the cockpit 7 keeps his/her legs in the foot space 7*c*.

As shown in FIG. 5, a distance D2 from the upper surface 107*c* (the upper surface 23*a* of the central deck 23) of the foot space 7*c* to the upper surface (seating surface 108*a*) of the seating surface 8*a* in the height direction is preferably about 800 mm, for example. Consequently, a user having a typical height maneuvers the jet boat 100 while leaning on the seating surface portion 8*a* from the bow side.

As shown in FIG. 2, the jet boat 100 is provided with an annular passage 9. The annular passage 9 includes a front portion 9*a*, a rear portion 9*b*, a portside portion 9*c*, and a starboard portion 9*d* and surrounds the entire circumference of the cockpit 7. The front portion 9*a* includes regions of the front deck 21 and the central deck 23 on the bow side. The rear portion 9*b* includes the rear deck 22 and the foot space 7*c*. The portside portion 9*c* and the starboard portion 9*d* include a region of the central deck 23 in the portside direction and a region of the central deck 23 in the starboard direction, respectively. Consequently, the user is capable of fishing 360 degrees around the cockpit 7 in all directions.

The structure of the rear bulwark 26 and the structure around the rear bulwark 26 are now described with reference to FIGS. 1, 2, 5, and 9.

The rear bulwark 26 arranged between the rear deck 22 and the platform 24 extends in the width direction of the boat body 3 from the portside of the boat body 3 to the starboard of the boat body 3 on the stern side relative to the engine housing 22*b* in the longitudinal direction of the boat body 3, as shown in FIGS. 1 and 2. The upper surface 26*a* of the rear bulwark 26 is preferably located at the same or substantially the same height from the portside of the boat body 3 to the starboard of the boat body 3 and is located below the upper surface of the portside bulwark 25*a* and the upper surface of the starboard bulwark 25*b*.

According to a preferred embodiment of the present invention, the upper surface 26*a* of the rear bulwark 26 is located above the upper surface 107*c* (the upper surface 23*a* of the central deck 23) of the foot space 7*c* and below the seating surface 108*a* of the seat 8, as shown in FIG. 5. A distance D3 from the upper surface 26*a* of the rear bulwark 26 to the upper surface (the upper surface 23*a* of the central deck 23) of the foot space 7*c* in the height direction is preferably about 620 mm, for example, and a distance D4 from the upper surface 26*a* of the rear bulwark 26 to the upper surface 22*a* of the rear deck 22 in the height direction is preferably about 200 mm, for example. Consequently, the distance D4 (about 200 mm, for example) from the upper surface 26*a* of the rear bulwark 26 to the upper surface 22*a* of the rear deck 22 in the height direction is smaller than the distance D1 (about 420 mm, for example) from the upper surface 23*a* of the central deck 23 to the upper surface 22*a* of the rear deck 22 in the height direction and is not greater than about ½ the distance.

The inner surface 26*b* of the rear bulwark 26 on the bow side extends upward. The outer surface 26*c* of the rear bulwark 26 on the stern side extends obliquely upward and toward a bow so as to intersect with the upper surface 28*a* of a second platform 28 described below. A pair of ventilating holes 26*d* (see FIG. 9) are provided in the outer surface 26*c*. The ventilating holes 26*d* provide communication between the engine housing 22*b* and the outside so as to ventilate the engine housing 22*b*.

Figure 9:
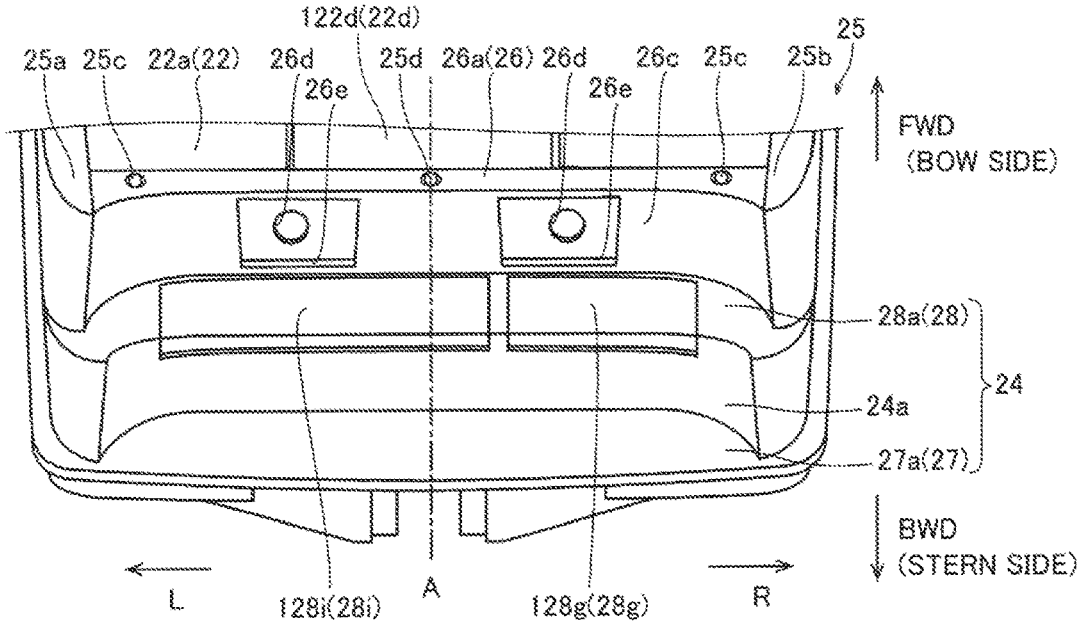
FIG. 9 is a diagram showing a state where an opening of a second platform of the jet boat according to a preferred embodiment of the present invention is closed.

As shown in FIG. 9, the respective pair of ventilating holes 26*d* are provided in the bottom surfaces of a pair of recessed portions 26*e* of the outer surface 26*c*. The ventilating holes 26*d* are covered with cushions 26*f* provided in the recessed portions 26*e* from the stern side, as shown in FIG. 5. Consequently, entry of extraneous material such as water from the stern side into the engine housing 22*b* through the ventilating holes 26*d* is significantly reduced or prevented.

The structure of the rear deck 22 and the structure around the rear deck 22 are now described in detail with reference to FIGS. 2, 5, 7, and 8.

The rear deck 22 includes an opening 22*c* provided at a position that corresponds to the engine housing 22*b* and that opens upward, and a hatch 22*d* that covers the opening 22*c* from above. The opening 22*c* and the hatch 22*d* are provided on the boat body centerline A along substantially an entire region of the rear deck 22 in the longitudinal direction. The opening 22*c* and the hatch 22*d* are examples of the "engine housing opening" and the "engine housing hatch" in a preferred embodiment of the present invention, respectively.

The opening 22*c* preferably has a rectangular or substantially rectangular shape that is longer in the longitudinal direction of the boat body 3 in a plan view from above. The opening 22*c* is provided in a portion of the rear deck 22 above the engine housing 22*b*, as shown in FIG. 5 and is provided at a position that overlaps with substantially an entire upper end 4*a* of the engine 4 in the engine housing 22*b* in a plan view from above.

The hatch 22*d* preferably has a rectangular or substantially rectangular shape so as to cover the opening 22*c* in a plan view from above. The hatch 22*d* is rotated within an angular range of about 90 degrees, for example, about a rotating shaft 22*e* provided in the vicinity of the rear bulwark 26 in a portion of the rear deck 22 on the stern side.

Figure 7:
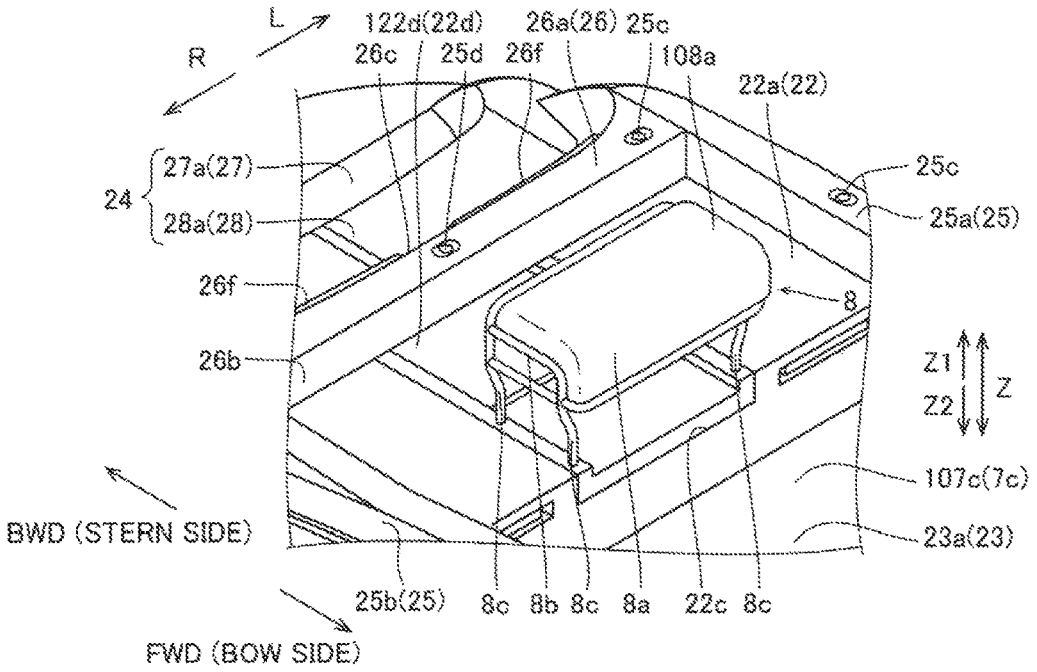
FIG. 7 is a perspective view showing a state where an opening of a rear deck of the jet boat according to a preferred embodiment of the present invention is closed.
Figure 8:
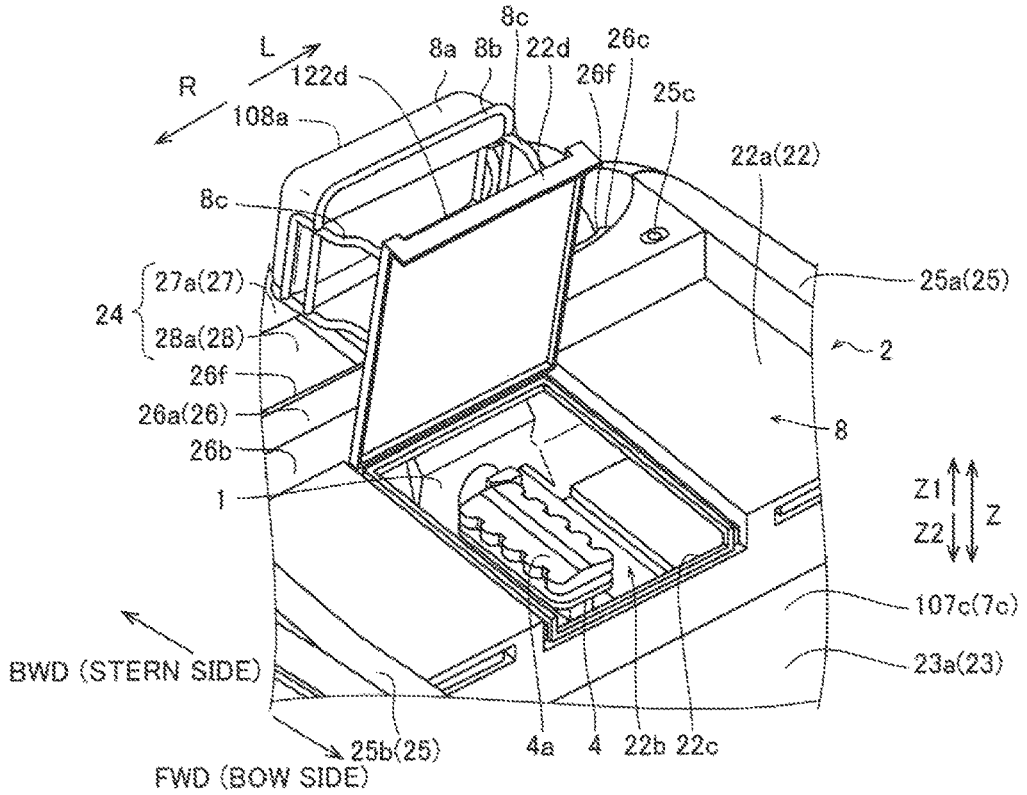
FIG. 8 is a perspective view showing a state where the opening of the rear deck of the jet boat according to a preferred embodiment of the present invention is open.

Consequently, the open and closed states of the opening 22*c* are switched by opening and closing the hatch 22*d*. Specifically, as shown in FIG. 7, in the closed state of the opening 22*c*, the hatch 22*d* is disposed over the opening 22*c*, and hence the opening 22*c* is closed. In the closed state of the opening 22*c*, the upper surface 22*a* of the rear deck 22 and the upper surface 122*d* of the hatch 22*d* are substantially flush with the upper surface 122*d* of the hatch 22*d*. The hatch 22*d* is rotated about the rotating shaft 22*e* (see FIG. 5) such that the opening 22*c* opens from the bow side, as shown in FIG. 8. When the hatch 22*d* extends upward by being rotated by about 90 degrees, for example, the opening 22*c* is fully open, and the engine 4 in the engine housing 22*b* is seen from above.

As shown in FIG. 7, the legs 8*c* of the seat 8 are fixed to the upper surface 122*d* of the hatch 22*d* on the bow side. Thus, the seat 8 is rotated within an angular range of about 90 degrees, for example, about the rotating shaft 22*e* together with the hatch 22*d*, thus following the opening of the hatch 22*d* and moved toward the stern side. As shown in FIG. 5, a distance D5 from the legs 8*c* of the seat 8 located on the stern side to the rotating shaft 22*e* is larger than the distance D4 from the upper surface 26*a* of the rear bulwark 26 to the upper surface 22*a* of the rear deck 22. Consequently, even when the seat 8 is rotated by about 90 degrees, following the rotation of the hatch 22*d* by about 90 degrees, contact of the seating surface 108*a* and the legs 8*c* of the seat 8 with the upper surface 26*a* of the rear bulwark 26 is significantly reduced or prevented due to the distance D5 being larger than the distance D4, as shown in FIG. 8.

As shown in FIG. 7, the upper surface 122*d* of the hatch 22*d* is recessed downward in the region surrounded by the legs 8*c* of the seat 8. Thus, movement of the cool box (not shown) is significantly reduced or prevented when the cool box is provided. On the other hand, the upper surface 22*a* of the rear deck 22 and the upper surface 122*d* of the hatch 22*d* are substantially flush with each other, except for a portion of the hatch 22*d* on the bow side to which the seat 8 is fixed. Thus, the user is able to easily move about the rear deck 22.

The structure of the platform 24 and the structure around the platform 24 are now described with reference to FIGS. 3, 5, 6, 9, and 10.

The platform 24 includes a first platform 27 located on the stern of the boat body 3 and a second platform 28 provided in a portion closer to the bow than the first platform 27, as shown in FIGS. 3 and 9. Both the upper surface 27*a* of the first platform 27 and the upper surface 28*a* of the second platform 28 are preferably flat.

The upper surface 28*a* of the second platform 28 is provided above the upper surface 27*a* of the first platform 27. The platform 24 is two stair-shaped, and the second platform 28 defines and functions as a step ladder when the user moves from the rear deck 22 to the first platform 27 and where the user sits on the platform 24 without getting his/her feet wet.

The upper surface 27*a* of the first platform 27 and the upper surface 28*a* of the second platform 28 are connected to each other through a step surface 24*a*. The step surface 24*a* extends obliquely upward and toward the bow.

As shown in FIG. 5, a distance D6 from the upper surface 27*a* of the first platform 27 to the upper surface 26*a* of the rear bulwark 26 is smaller than the distance D3 from the upper surface 107*c* of the foot space 7*c* to the upper surface 26*a* of the rear bulwark 26. Consequently, the upper surface 27*a* of the first platform 27 is located above the upper surface 107*c* (the upper surface 23*a* of the central deck 23) of the foot space 7*c*. A distance D7 from the upper surface 28*a* of the second platform 28 to the upper surface 26*a* of the rear bulwark 26 is equal or substantially equal to the distance D4 from the upper surface 26*a* of the rear bulwark 26 to the upper surface 22*a* of the rear deck 22 in the height direction. Consequently, the upper surface 28*a* of the second platform 28 is located at the same or substantially the same height position as that of the upper surface 22*a* of the rear deck 22.

Figure 10:
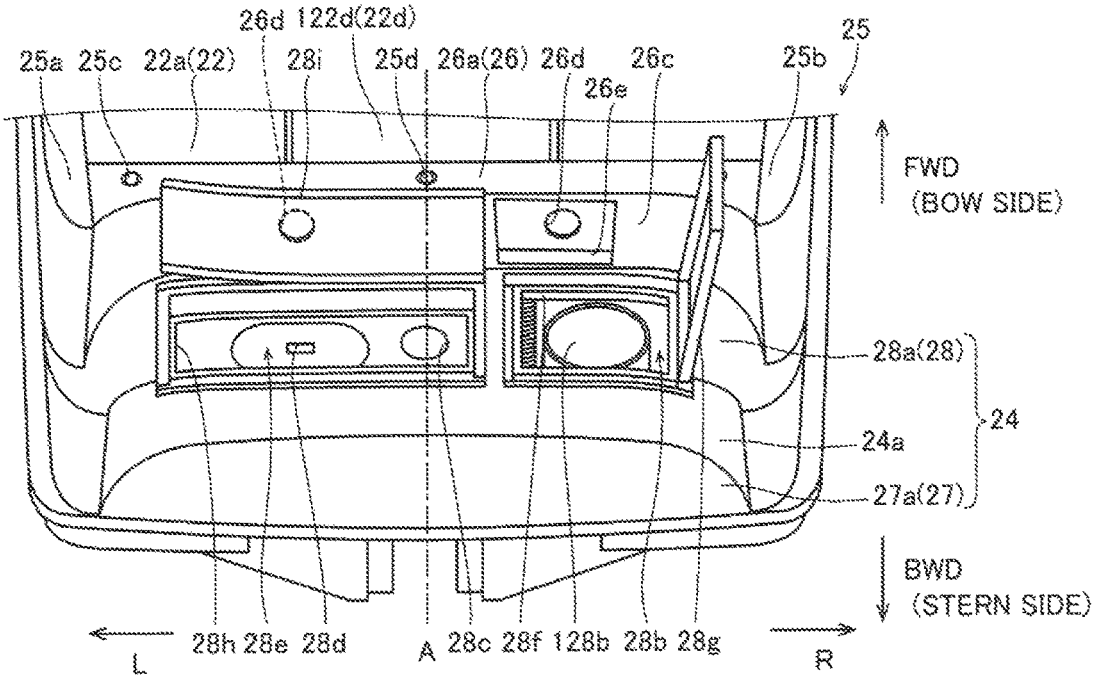
FIG. 10 is a diagram showing a state where the opening of the second platform of the jet boat according to a preferred embodiment of the present invention is open.

As shown in FIG. 10, an article housing 28*b* is provided below the second platform 28. The second platform 28 is provided with a maintenance hole 28*c* and a monitoring hole 28*d*. The article housing 28*b* extends in the height direction (see FIG. 5). One ventilating hole 26*d* is provided in the starboard direction of the outer surface 26*c* of the rear bulwark 26 that corresponds to the article housing 28*b*, and the other ventilating hole 26*d* is provided in the portside direction of the outer surface 26*c* of the rear bulwark 26 that corresponds to the monitoring hole 28*d*.

As shown in FIG. 6, the article housing 28*b* is displaced to the starboard of the second platform 28 so as to avoid the exhaust portion 4*b* arranged in the space in the portside direction relative to the engine 4. The maintenance hole 28*c* is provided on the boat body centerline A of the second platform 28 so as to be adjacent in the portside direction to the article housing 28*b*. As shown in FIG. 10, the monitoring hole 28*d* is provided in the portside direction of the second platform 28. Both the maintenance hole 28*c* and the monitoring hole 28*d* are provided in a recessed portion 28*e* provided in the second platform 28. This recessed portion 28*e* is more shallow in the height direction than the article housing 28*b*.

The second platform 28 includes an opening 28*f* provided at a position that corresponds to the article housing 28*b* and that opens upward, and a hatch 28*g* that covers the opening 28*f* from above. The hatch 28*g* is rotated from the portside toward the starboard, and hence the opening 28*f* is opened from the portside direction. The opening 28*f* and the hatch 28*g* are examples of the "article housing opening" and the "article housing hatch" in a preferred embodiment of the present invention, respectively.

The second platform 28 further includes an opening 28*h* provided at a position that corresponds to the recessed portion 28*e* and that opens upward, and a hatch 28*i* that covers the opening 28*h* from above. The hatch 28*i* is rotated from the stern toward the bow, and hence the opening 28*h* is opened from the stern side.

The upper surface 128*g* of the hatch 28*g* and the upper surface 128*i* of the hatch 28*i* are flush or substantially flush with the upper surface 28*a* of the second platform 28, and hence the upper surface 128*g* of the hatch 28*g* and the upper surface 128*i* of the hatch 28*i* are arranged at the same or substantially the same height position as those of the upper surface 22*a* of the rear deck 22 and the upper surface 122*d* of the hatch 22*d*. Thus, a height of a step on the second platform 28 is significantly reduced, and the user more safely moves between the second platform 28 and the rear deck 22.

In the article housing 28*b*, a 5-gallon bucket 128*b*, for example, is housed such that an opening is located there above. Thus, caught fish is put in the bucket 128*b* housed in the article housing 28*b* when the user fishes on the platform 24. The bucket 128*b* is an example of the "article" in a preferred embodiment of the present invention.

Through the maintenance hole 28*c* and the monitoring hole 28*d*, an impeller (not shown) of the jet propulsion unit 5 and the ejection hole 1*a* (see FIG. 5) are viewable. The user maintains the jet propulsion unit 5 by removing waterweeds or the like through the maintenance hole 28*c* when the waterweeds or the like get stuck in the impeller and the ejection hole 1*a*.

According to various preferred embodiments of the present invention, the following advantageous effects are obtained.

According to a preferred embodiment of the present invention, the upper surface 26*a* of the rear bulwark 26 arranged between the platform 24 and the cockpit 7 is preferably located above the upper surface 107*c* of the foot space 7*c* and below the seating surface 108*a* of the seat 8. Thus, the upper surface 26*a* of the rear bulwark 26 is arranged below the seating surface 108*a* of the seat 8, and hence the user is capable of stepping over the rear bulwark 26 simply by slightly raising his/her foot in the height direction when moving from the deck 2 to the platform 24. Consequently, the user easily moves from the deck 2 to the platform 24.

According to a preferred embodiment of the present invention, the upper surface 22*a* of the rear deck 22 arranged between the foot space 7*c* and the rear bulwark 26 is preferably located above the upper surface 107*c* of the foot space 7*c* and below the upper surface 26*a* of the rear bulwark 26. Thus, the user more easily moves from the deck 2 to the platform 24 by moving over the rear deck 22.

According to a preferred embodiment of the present invention, the distance D4 from the upper surface 26*a* of the rear bulwark 26 to the upper surface 22*a* of the rear deck 22 in the height direction is preferably smaller than the distance D1 from the upper surface 107*c* of the foot space 7*c* to the upper surface 22*a* of the rear deck 22 in the height direction. Thus, when the user moves from the rear deck 22 to the platform 24, the distance (a height to which the user raises his/her foot) D4 in the height direction over which the user moves is further reduced, and hence the user more easily moves from the rear deck 22 to the platform 24.

According to a preferred embodiment of the present invention, the engine housing 22*b* in which the engine 4 is housed is preferably provided in the region that is below the rear deck 22 and corresponds to the rear deck 22. Thus, the engine housing 22*b* is provided below the rear deck 22 which includes the upper surface located above the upper surface 107*c* of the foot space 7*c*, and hence a large space for the engine housing 22*b* is ensured in the height direction.

According to a preferred embodiment of the present invention, the rear deck 22 includes the opening 22*c* preferably provided at a position that corresponds to the engine housing 22*b* and that opens upward, and the hatch 22*d* that opens and closes the opening 22*c*. Thus, the user is capable of maintaining the engine 4 housed in the engine housing 22*b* from above through the opening 22*c*. Furthermore, when the user does not maintain the engine 4, the hatch 22*d* closes the opening 22*c* not to allow the opening 22*c* to hinder movement of the user about the rear deck 22.

According to a preferred embodiment of the present invention, the seat 8 is preferably fixed to the upper surface 122*d* of the hatch 22*d* so as to follow the opening and closing of the hatch 22*d*. Thus, the seat 8 does not hinder movement of the hatch 22*d* when the opening 22*c* is opened.

According to a preferred embodiment of the present invention, the seat 8 also follows the opening and closing of the hatch 22*d* such that the user is not required to remove the seat 8 from the hatch 22*d* and, thus, the removed seat 8 is not lost.

According to a preferred embodiment of the present invention, the hatch 22*d* preferably rotates about the rotating shaft 22*e* provided on the stern side so as to open the opening 22*c* from the bow side. Thus, the user is capable of maintaining the engine 4 arranged below the rear deck 22 in a state where the user stands with his/her feet in the foot space 7*c* on the bow side relative to the rear deck 22. Thus, the user is capable of maintaining the engine 4 at a position close to the engine 4, and hence the user easily maintains the engine 4.

According to a preferred embodiment of the present invention, the seat 8 is preferably fixed to the upper surface 122*d* of the hatch 22*d* on the bow side, and the distance D2 from the upper surface 26*a* of the rear bulwark 26 to the upper surface 22*a* of the rear deck 22 in the height direction is preferably smaller than the distance D5 from the seat 8 to the rotating shaft 22*e* in the longitudinal direction in the closed state of the hatch 22*d*. Thus, contact of the seat 8 that moves toward the stern side with the rear bulwark 26 is significantly reduced or prevented when the hatch 22*d* is rotated at least within the angular range of about 90 degrees so as to open the opening 22*c*. Thus, the opening 22*c* is sufficiently opened even in the case where the seat 8 is fixed to the hatch 22*d*.

According to a preferred embodiment of the present invention, the opening 22*c* is preferably provided at a position that overlaps with substantially the entire upper end 4*a* of the engine 4 in the engine housing 22*b* in a plan view. Thus, the user easily sees substantially the entire upper end 4*a* of the engine 4 through the opening 22*c*, and hence maintenance of the engine 4 is improved.

According to a preferred embodiment of the present invention, the platform 24 is preferably integral with the deck 2. Thus, the platform 24 is not required to be separate and fixed to the boat body 3, and hence the efficiency of assembling the jet boat 100 is improved.

According to a preferred embodiment of the present invention, the platform 24 preferably includes the first platform 27 and the second platform 28 provided on the bow side relative to the first platform 27, and including the upper surface 28*a* located above the upper surface 27*a* of the first platform 27 and below the upper surface 26*a* of the rear bulwark 26. Thus, the user easily steps over the rear bulwark 26, using the second platform 28 including the upper surface 28*a* located above the upper surface 27*a* of the first platform 27 as a step ladder when moving from the deck 2 to the first platform 27. Thus, the user more easily moves from the deck 2 to the platform 24.

According to a preferred embodiment of the present invention, the upper surface 28*a* of the second platform 28 is preferably above the upper surface 107*c* of the foot space 7*c*. Thus, when the user moves from the platform 24 to the deck 2 by stepping over the rear bulwark 26, the distance (a height to which the user raises his/her foot) D6 in the height direction over which the user steps is reduced, and hence the user easily moves from the platform 24 to the deck 2.

According to a preferred embodiment of the present invention, the upper surface 28*a* of the second platform 28 is preferably located at the same or substantially the same height position as that of the upper surface 22*a* of the rear deck 22. According to this structure, the height position remains almost unchanged before and after the user steps over the rear bulwark 26, and hence the user easily moves between the rear deck 22 and the second platform 28.

According to a preferred embodiment of the present invention, the article housing 28*b* in which an article (e.g., bucket 128*b*) is housed is preferably provided in a region that is below the second platform 28 and corresponds to the second platform 28. Thus, the article housing 28*b* is provided below the second platform 28 including the upper surface 28*a* located above the upper surface 27*a* of the first platform 27, and hence a large space for the article housing 28*b* is ensured in the height direction. Thus, even an article such as the bucket 128*b* is arranged to extend in the height direction in the article housing 28*b*, and hence even the bucket 128*b* in which water is contained is easily housed.

According to a preferred embodiment of the present invention, the second platform 28 preferably includes the opening 28*f* provided at a position that corresponds to the article housing 28*b* and that opens upward, and the hatch 28*g* opens and closes the opening 28*f*. Thus, the user easily houses the article (bucket 128*b*) in the article housing 28*b* from above through the opening 28*f*, and the hatch 28*g* closes the opening 28*f* in a state where the article is housed in the article housing 28*b* so as to prevent the article from jumping out through the opening 28*f*.

According to a preferred embodiment of the present invention, the upper surface 128*g* of the hatch 28*g* and the upper surface 128*i* of the hatch 28*i* are preferably arranged at the same or substantially the same height position as those of the upper surface 22*a* of the rear deck 22 and the upper surface 122*d* of the hatch 22*d*. Thus, when the user moves between the upper surface 122*d* of the hatch 22*d* and the upper surface 128*g* of the hatch 28*g* by stepping over the rear bulwark 16, the height position remains almost unchanged before and after the user steps over the rear bulwark 26, and hence the user easily moves between the upper surface 122*d* of the hatch 22*d* and the upper surface 128*g* of the hatch 28*g* (the upper surface 128*i* of the hatch 28*i*) even in the case where the hatches 22*d* and 28*g* (28*i*) are provided in the rear deck 22 and the second platform 28, respectively.

According to a preferred embodiment of the present invention, the exhaust portion 4*b* connected to the engine 4 is preferably arranged in the portside direction of the boat body 3 with respect to the boat body centerline A, and the article housing 28*b* is deviated in the starboard direction of the boat body 3 with respect to the boat body centerline A. Thus, a reduction in the volume of a space of the article housing 28*b* due to the exhaust portion 4*b* is significantly reduced or prevented, and hence a sufficient space is ensured for the article housing 28*b*.

According to a preferred embodiment of the present invention, the maintenance hole 28*c* is preferably provided on the boat body centerline A of the second platform 28 so as to be adjacent in the portside direction to the article housing 28*b*. Thus, even in the case where the article housing 28*b* is provided in the second platform 28, the jet propulsion unit 5 is maintained through the maintenance hole 28*c* adjacent to the article housing 28*b*. Furthermore, the maintenance hole 28*c* is provided on the boat body centerline A such that the jet propulsion unit 5 located on the boat body centerline A is easily maintained.

According to a preferred embodiment of the present invention, the ventilating hole 26*d* that ventilates the engine housing 22*b* is preferably provided at a position in the starboard direction that corresponds to the article housing 28*b* in the outer surface 26*c* of the rear bulwark 26 on the stern side. Thus, as compared with the case where the ventilating hole 26*d* is provided on the bow side, the engine housing 22*b* is ventilated while entry of extraneous material or the like from the bow side into the engine housing 22*b* through the ventilating hole 26*d* following movement of the jet boat 100 in the forward movement direction (bow side, FWD) is significantly reduced or prevented.

According to a preferred embodiment of the present invention, the upper surface 27*a* of the first platform 27 is preferably located above the upper surface 107*c* of the foot space 7*c*. Thus, the distance D6 from the upper surface 27*a* of the first platform 27 to the upper surface 26*a* of the rear bulwark 26 in the height direction is smaller than the distance D3 from the upper surface of the foot space to the upper surface 26*a* of the rear bulwark 26 in the height direction, and hence the user is capable of stepping over the rear bulwark 26 simply by slightly raising his/her foot in the height direction when moving from the first platform 27 to the deck 2. Furthermore, the user more easily steps over the rear bulwark 26, using the second platform 28 including the upper surface 28*a* located above the upper surface 27*a* of the first platform 27 as a step ladder.

According to a preferred embodiment of the present invention, the annular passage 9 including the rear deck 22 preferably surrounds the entire circumference of the cockpit 7. Thus, the user easily moves in the portside direction and the starboard direction in the width direction of the boat body 3 and toward the bow and the stern in the longitudinal direction of the boat body 3 by moving in the annular passage 9, and hence the user is capable of fishing at any position of the circumferential edge of the boat body 3.

The preferred embodiments of the present invention described above are illustrative in all points and not restrictive. The extent of the present invention is not defined by the above description of the preferred embodiments but by the scope of claims, and all modifications within the meaning and ranges equivalent to the scope of claims are further included.

For example, while the platform 24 is preferably integral with the deck 2 in a preferred embodiment described above, the present invention is not restricted to this. According to a preferred embodiment of the present invention, the platform may alternatively be separate from the deck and fixed to the deck.

While the upper surface 26*a* of the rear bulwark 26 is preferably located at the same or substantially the same height position from the portside of the boat body 3 to the starboard of the boat body 3 in a preferred embodiment described above, the present invention is not restricted to this. According to a preferred embodiment of the present invention, a portion on the boat body centerline of the upper surface of the rear bulwark may alternatively be recessed downward relative to the remaining portion, for example. Thus, the user more easily moves from the deck to the platform.

While the distance D4 from the upper surface 26*a* of the rear bulwark 26 to the upper surface 22*a* of the rear deck 22 in the height direction is preferably smaller than the distance D1 from the upper surface 23*a* of the central deck 23 to the upper surface 22*a* of the rear deck 22 in the height direction in a preferred embodiment described above, the present invention is not restricted to this. According to a preferred embodiment of the present invention, the distance D4 may alternatively be equal to or greater than the distance D1.

While the seat 8 is preferably fixed to the upper surface 122*d* of the hatch 22*d* of the rear deck 22 in a preferred embodiment described above, the present invention is not restricted to this. According to a preferred embodiment of the present invention, the seat may not be fixed to the rear deck (rear passage). The seat may alternatively be fixed to the upper surface of the central deck located below the upper surface of the rear deck, for example.

While the upper surface 21*a* of the front deck 21 and the upper surface 22*a* of the rear deck 22 are preferably located above the upper surface 23*a* of the central deck 23 in the deck 2 in a preferred embodiment described above, the present invention is not restricted to this. According to a preferred embodiment of the present invention, the upper surfaces of the front deck, the rear deck, and the central deck may alternatively be located at the same or substantially the same height positions in the deck.

While the platform 24 preferably has a two-step shape including the first platform 27 and the second platform 28 in a preferred embodiment described above, the present invention is not restricted to this. According to a preferred embodiment of the present invention, the platform may not have a step shape such that no second platform is provided. Alternatively, the platform may have a three-or-more step shape.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet boat comprising:

a boat body including a hull and a deck;

an engine housed in the hull below the deck;

a jet propulsion unit driven by the engine;

a cockpit arranged on the deck in a central portion of the boat body in a longitudinal direction of the boat body, and on a boat body centerline that extends in the longitudinal direction of the boat body, the cockpit including a seat provided on the deck, a handle, and a foot space between the seat and the handle;

a bulwark that extends upward along a circumference of the deck to prevent entry of waves onto the deck; and a platform provided at a stern of the jet boat; wherein the bulwark includes a rear bulwark arranged between the platform and the cockpit, and an upper surface of the rear bulwark is located above an upper surface of the foot space and below a seating surface of the seat;

the jet boat further includes an engine housing in which the engine and at least a portion of a drive shaft connected to the engine are housed, an engine housing opening provided at a position that corresponds to a position of the engine housing and that opens upward, and an engine housing hatch that opens and closes the engine housing opening;

the seat is fixed to an upper surface of the engine housing hatch, and moves and follows the opening and closing of the engine housing hatch; and the deck includes a rear passage between the foot space and the rear bulwark.

2. The jet boat according to claim 1, wherein the rear passage includes an upper surface located above the upper surface of the foot space and below an upper surface of the rear bulwark; and a distance from the upper surface of the rear bulwark to the upper surface of the rear passage in a height direction is smaller than a distance from the upper surface of the foot space to the upper surface of the rear passage in the height direction.

3. The jet boat according to claim 2, wherein the engine housing is located in a region that is below the rear passage and corresponds to a position of the rear passage.

4. The jet boat according to claim 2, wherein the engine housing opening and the engine housing hatch are provided at the rear passage.

5. The jet boat according to claim 1, wherein the engine housing opening is provided at a position that overlaps with an entire or substantially an entire upper end of the engine housed in the engine housing in a plan view.

6. The jet boat according to claim 1, wherein the platform is integral with the deck.

7. The jet boat according to claim 1, wherein the platform includes a first platform and a second platform provided on a bow side relative to the first platform and including an upper surface located above an upper surface of the first platform and below the upper surface of the rear bulwark.

8. The jet boat according to claim 7, wherein the upper surface of the second platform is provided above the upper surface of the foot space.

9. The jet boat according to claim 8, wherein the rear passage includes an upper surface located above the upper surface of the foot space and below the upper surface of the rear bulwark; and the upper surface of the second platform is located at a same or substantially a same height position as that of the upper surface of the rear passage.

10. The jet boat according to claim 2, wherein the deck further includes an annular passage that surrounds an entire circumference of the cockpit, including the rear passage.

11. A jet boat comprising:

a boat body including a hull and a deck;

an engine housed in the hull below the deck;

a jet propulsion unit driven by the engine;

a cockpit arranged on the deck in a central portion of the boat body in a longitudinal direction of the boat body, and on a boat body centerline that extends in the longitudinal direction of the boat body, the cockpit including a seat provided on the deck, a handle, and a foot space between the seat and the handle;

a bulwark that extends upward along a circumference of the deck to prevent entry of waves onto the deck; and a platform provided at a stern of the jet boat; wherein the bulwark includes a rear bulwark arranged between the platform and the cockpit, and an upper surface of the rear bulwark is located above an upper surface of the foot space and below a seating surface of the seat;

the jet boat further includes an engine housing in which the engine and at least a portion of a drive shaft connected to the engine are housed, an engine housing opening provided at a position that corresponds to a position of the engine housing and opens upward, and an engine housing hatch that opens and closes the engine housing opening;

the engine housing hatch includes a rotating shaft provided on a stern side of the engine housing hatch;

the engine housing hatch rotates about the rotating shaft so as to open the engine housing opening from a bow side; and the deck includes a rear passage between the foot space and the rear bulwark.

12. The jet boat according to claim 11, wherein the seat is fixed to an upper surface of the engine housing hatch on the bow side and moves toward the stern and follows the opening of the engine housing hatch; and the distance from the upper surface of the rear bulwark to the upper surface of the rear passage in the height direction is smaller than a distance from the seat to the rotating shaft in the longitudinal direction of the boat body in a closed state of the engine housing hatch.

13. The jet boat according to claim 11, wherein the rear passage includes an upper surface located above the upper surface of the foot space and below an upper surface of the rear bulwark; and a distance from the upper surface of the rear bulwark to the upper surface of the rear passage in a height direction is smaller than a distance from the upper surface of the foot space to the upper surface of the rear passage in the height direction.

14. The jet boat according to claim 13, wherein the engine housing is located in a region that is below the rear passage and corresponds to a position of the rear passage.

15. The jet boat according to claim 13, wherein the engine housing opening and the engine housing hatch are provided at the rear passage.

16. The jet boat according to claim 11, wherein the engine housing opening is provided at a position that overlaps with an entire or substantially an entire upper end of the engine housed in the engine housing in a plan view.

17. The jet boat according to claim 11, wherein the platform is integral with the deck.

18. The jet boat according to claim 11, wherein the platform includes a first platform and a second platform provided on a bow side relative to the first platform and including an upper surface located above an upper surface of the first platform and below the upper surface of the rear bulwark.

19. The jet boat according to claim 18, wherein the upper surface of the second platform is provided above the upper surface of the foot space.

20. The jet boat according to claim 12, wherein the deck further includes an annular passage that surrounds an entire circumference of the cockpit, including the rear passage.

* * * * *